US005267653A

United States Patent [19]

Anani

[11] Patent Number: 5,267,653

[45] Date of Patent: Dec. 7, 1993

[54] SORTING METHOD AND SORTING DEVICE

[76] Inventor: Riad M. Anani, P.O. Box 4561, Station D, London, Ontario, Canada, N5W 5J5

[21] Appl. No.: 917,301

[22] Filed: Jul. 23, 1992

[51] Int. Cl.[5] ..... B03B 5/66

[52] U.S. Cl. ..... 209/156; 209/172

[58] Field of Search ..... 209/422, 444, 451, 18, 209/435, 436, 437, 439, 445, 156, 155, 158, 173, 172, 172.5

[56] References Cited

U.S. PATENT DOCUMENTS 3,550,773 12/1970 Villani et al. ..... 209/158

FOREIGN PATENT DOCUMENTS 386997 12/1923 Fed. Rep. of Germany ..... 209/156

47517 8/1920 Sweden ..... 209/156

*Primary Examiner*—Robert P. Olszewski

*Assistant Examiner*—Kenneth Noland

[57] ABSTRACT

The present invention provides a sorting method and a sorting device for sorting particles according to their settling velocities in a fluid medium. According to one aspect, the sorting method comprises admitting particles into a longitudinally vertically positioned container containing a fluid and allowing the particles to settle for a specified period of time under the influence of gravitational forces resulting in separation of the particles according to their settling velocities, followed by rotating the container by 90 degrees in order for the container to take a longitudinally horizontal position and thus allowing the separated particles to settle down and be collected in a sorted fashion. The sorting device comprises a container and means for achieving sorting of particles using this sorting method.

14 Claims, 2 Drawing Sheets

SORTING METHOD AND SORTING DEVICE

BACKGROUND OF THE INVENTION

The present invention relates to a sorting method and a sorting device for sorting particles according to their settling velocities in a fluid medium using gravitational forces for both separation of the particles into groups of particles having similar settling velocities and collection of such separated (grouped) particles in sorted fashion.

The present invention may be useful in detecting the presence of gold in sands. Further, it may provide a basis for a large-scale gold production. The present invention may also be useful in easily sorting several kinds of particles such as granulated anaerobic sludges according to the settling velocities of the granules and thus providing data for evaluating the performance of anaerobic digestion systems.

There are methods currently in use for sorting particles according to their sizes using sieves and according to their settling properties; sorting of particles according to their settling properties include pumping water at increasing upflow velocities into a column where the particles are placed for sorting, and, through an overflow port in the column, the upflow water currents carry the particles "sorted in fractions" corresponding to the upflow velocities themselves.

However, using sieves is associated with operational and maintenance problems resulting from mesh clogging of the sieves. On the other hand, using increasing upflow velocities is time consuming. Moreover, when the particles are delicate in structure, such as granulated anaerobic sludges, methods based on using sieves or upflow velocities tend to subject the particles to shear stress over relatively long periods of time resulting in damage and possible disintegration of such delicate particles. This brings into question the performance and reliability of these methods. This is due to the fact that when larger particles disintegrate into small fragments, the settling properties of the resulting fragments are different from the original particles. Therefore, the fragments do not represent the real status of the original particles before sorting.

SUMMARY OF THE INVENTION

It is desirable to have a method for sorting particles which is quick, economical, practical, and entails minimum shear stress on the particles. A device through which such a method can be used is also desirable. The present invention relates to a sorting method and a sorting device having the just mentioned advantages.

According to one aspect, the present invention provides a method for sorting particles according to their settling velocities. The method comprises admitting particles into a container containing a fluid and allowing the particles to start to settle according to their settling velocities under the influence of gravitational forces. After the particles travel through the fluid inside the container for a specified period of time and the corresponding separation of the particles according to their settling velocities takes place, this method requires rotating the container about an axis in order to change the direction of the settling movements of the settling particles in relation to longitudinal lines in the walls of the container, so that the gravitational forces pull down the now separated particles causing them to be collected in a sorted fashion according to their settling velocities. The just mentioned longitudinal lines in the walls of the container may be real or imaginary.

Particles that can be sorted by this method may be manufactured. Also, the particles may be found free in nature and may relate to mineral deposits, soil, sand, gold, or any combination including such materials. The particles may comprise anaerobic sludge granules. Furthermore, the particles may comprise cellular structures the study of which has biological significance, for example algae. Also, the particles may originate from an animal source the examination of which has medical or veterinary significance, for example coagulated food or blood particles.

The fluid utilized in this method may comprise a liquid. The liquid may be aqueous. Further, the fluid may comprise a gas. The gas may be air. Also, the fluid may comprise a liquid mixture, a gas mixture, or a gas-liquid mixture.

A preferred aspect of this method for sorting particles comprises admitting particles into a container, preferably cylindrical in shape, containing fluid wherein the container takes a longitudinally vertical position The particles start to settle according to their settling velocities in the fluid under the influence of gravitational forces. After the particles travel through the fluid inside the container for a specified period of time and the corresponding separation of the particles according to their settling velocities takes place, the preferred aspect of this method requires rotating the container about an axis by 90 degrees in order for the container to take a longitudinally horizontal position, so that the gravitational forces pull down the now separated particles causing them to be collected in sorted fashion according to their settling velocities.

This invention comprises any method for sorting particles according to their settling velocities in a container containing a fluid, wherein gravitational forces are used for both separation and collection of the particles. In the stage of the preferred aspect of this method of sorting particles when the container is in a longitudinally vertical position, separation of the particles takes place under the influence of gravitational forces. Afterwards, when the container is rotated in order to take a longitudinally horizontal position, collection of the now separated particles takes place in sorted fashion under the influence of gravitational forces as well.

According to another aspect, the present invention provides a device comprising a container, the device has the capability of sorting particles according to their settling velocities in a fluid medium inside the container. The sorting is influenced by changing the direction of the settling movements of the settling particles in relation to longitudinal lines in the walls of the container. The changing in the direction of the settling movements may require that the sorting device has means, for example a rotary force source, for changing an angle related to the way in which the container is positioned in relation to a fixed reference.

Therefore, the sorting device may have means for changing the angle that a central axis of the container makes with a horizontal line, including means for changing the angle by 90 degrees. The sorting device may have means for changing the angle that a central axis of the container makes with a vertical line, including means for changing the angle by 90 degrees. The sorting device may have means for changing the angle that a central axis of the container makes with any reference line, including means for changing the angle by 90 degrees. The sorting device may have means for changing the angle that a central plane of the container make with any reference plane, including means for changing the angle by 90 degrees. The sorting device may have means for rotating the container about an axis in order to change the longitudinal position of the container in relation to a vertical line. The sorting device may have means for rotating the container about an axis in order to change the longitudinal position of the container in relation to a horizontal line. The sorting device may have means for rotating the container about an axis in order to change the longitudinal position of the container in relation to any reference line. The sorting device may have means for rotating the container about an axis in order to change the longitudinal position of the container in relation to any reference plane. Means for rotating the container about an axis may include mechanical and electrical means. Controlling the means for rotating the container about an axis may be manual or automatic or a combination of both.

Although it is preferable to have a cylindrical shape for the container of the sorting device, other shapes are also possible such as rectangular, for example. The container may have longitudinally placed collection ports to be used for collecting sorted particles. Each collection port may comprise portions defining a cone for example. The sorting device may have means for charging particles into the container for sorting and means for discharging the sorted particles out the container. The means for charging the particles into the container may include a valve having magnetic components, or a spring which may keep the valve closed except while the spring is subjected to force aimed at causing the valve to open in order for the particles to be charged into the container. The sorting device may have means for attaching the container to a support stand while maintaining the capability of the container to rotate about an axis passing through both the container and the support stand. Furthermore, the sorting device has means which allow fluid materials to enter into and exit out of the container of the sorting device.

The present invention comprises any device having the capability of sorting particles according to their settling velocities in a container containing a fluid, wherein gravitational forces are used for both separation and collection of the particles. For example, the case may be considered when a device for sorting particles according to the present invention is used in conjunction with the preferred aspect of the method of sorting particles. In the stage of the preferred aspect of the method when the container is in a longitudinally vertical position, separation of the particles take place under the influence of gravitational forces. Afterwards, when the container is rotated in order to take a longitudinally horizontal position, collection of the now separated particles takes place in sorted fashion under the influence of gravitational forces as well.

According to another aspect, the present invention comprises a sorting device having the capability of sorting particles in a fluidized bed medium according to the settling velocities and fluidization characteristics of the particles, the sorting is influenced by changing the direction of the settling movements of the settling particles in relation to longitudinal lines in the walls of the container.

According to another aspect, the present invention comprises a sorting device including means for supplying fluid, air for example, into the container of the sorting device in such a way that the fluid flows inside the container opposite to the direction of the settling movements of the settling particles in order to slow down settling of the particles and, thus, make it possible to achieve a desired degree of sorting using a shorter container than would, otherwise, be required if such fluid supply is not used.

According to another aspect, the present invention comprises a sorting device including magnetic force, the sorting device has the capability of sorting particles using the response of the particles to the magnetic force.

BRIEF DESCRIPTION OF THE DRAWINGS

The invention, as exemplified by a preferred embodiment, is described in greater detail with reference to the drawings in which.

DETAILED DESCRIPTION OF THE PREFERRED EMBODIMENT(S)

Figure 1:
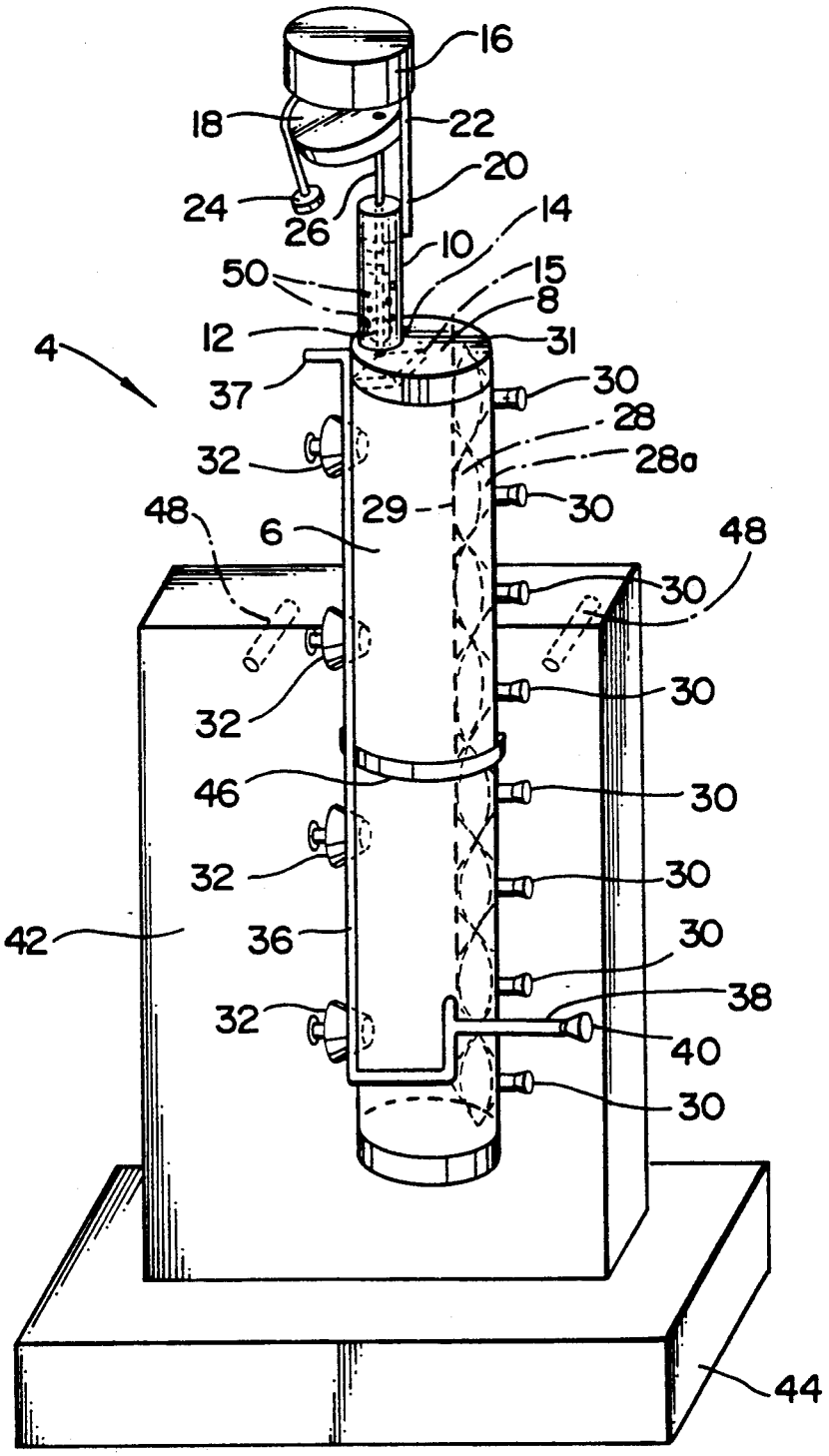
FIG. 1 is a perspective view of a sorting device when the container of the sorting device is in a longitudinally vertical position, according to a preferred embodiment of the present invention.

Referring to the drawings, FIG. 1 shows a sorting device generally indicated as 4. This sorting device comprises a cylindrical container 6. The container (called now cylinder 6) has a cover 8. Mounted on the cover is a charging port comprising cylinder 10 and having the capability of charging particles into cylinder 6. Cylinder 10 has its central longitudinal axis parallel to the central longitudinal axis of cylinder 6. The charging port is equipped with a valve system. The valve system comprises an opening 12 joining cylinder 10 with cylinder 6, an o-ring encircling opening 12 in the side of cylinder 6, a shutting plate 14 which may comprise rubber and has the capability of rotating about the central axis of hinge 15 which is attached to the inside face of cover 8, a magnet 16, a metal sheet 18, connecting bar 20 which connects magnet 16 to cylinder 10, a hinge 22 supported by connecting bar 20 (metal sheet 18 may rotate about the central axis of hinge 22), handle 24, and connecting bar 26 which passes through opening 12 in order to connect metal sheet 18 with shutting plate 14. Therefore, the valve system simply comprises stationary parts and moving parts. The stationary parts include magnet 16, hinge 22, connecting bar 20, and hinge 15. The moving parts include metal sheet 18, handle 24, connecting bar 26, and shutting plate 14.

Instead of magnet 16 (stationary part) and sheet 18 (moving part), a spring may be used to close opening 12 using a different mechanism. One end of the spring may be attached to a stationary part of the charging port, such as cylinder 10, while the other end of the spring is attached to a moving part, such as bar 26. In one aspect of this spring-related mechanism, the spring is subjected to a force directed downwards. The force may be exerted by the sorting device operator. The force is sufficient to overcome the spring resistance. Therefore, shutting plate 14 is pushed downwards and opening 12 is cleared (opened) and remains open as long as such a force is applied. However, when the downward force is removed, shutting plate 14 is pulled back up by the spring and thus opening 12 is closed.

Longitudinally aligned inside cylinder 6 are collection/discharging ports. Each port comprises a funnel 28. Each funnel extends outside cylinder 6 and is provided with a rubber stopper 30. A valve or a screw may be used instead of rubber stopper 30. A thin shallow wall 29 is placed between each pair of consecutive funnels in order to confine particles that miss the mouths of the funnels for later collection In another aspect, the part of cylinder 6 accommodating funnels 28 can be entirely solid. Such a solid part is indicated as 31 in the drawings. In this case, in lieu of funnels 28, each collection/discharge port comprises a portion 28*a* defining a cone 28 which may be made through the solid material.

For operational purposes such as washing, for example, cylinder 6 is provided with portions defining holes to give access to the interior of the cylinder. The holes themselves are not shown in the drawings because each hole is covered by a removable rubber stopper 32. Also, pipe 36 accesses cylinder 6. Pipe 36 is provided with branch pipe 38 which is provided with rubber stopper 40. The outlet of pipe 36 comprises portions defining opening 37. Opening 37 is positioned at the same level as opening 12. The purpose of pipe 36 will be explained during the discussion of the operation of the sorting device.

Support stand 42, and the attached support stand base 44, support the sorting device through a pivot shaft passing through portions defining a hole located in sliding ring 46. The portions defining a hole in sliding ring 46 and the pivot shaft are not shown because they are hidden between support stand 42 and sliding ring 46. In order to ensure steadiness of rotation of cylinder 6 and its attachments about the central axis of the pivot shaft, as will be discussed later, the difference is kept minimum between the inside diameter of sliding ring 46 and the outside diameter of cylinder 6; this minimizes the clearance between the interior surface of sliding ring 46 and the exterior surface of cylinder 6. Sliding ring 46 can slide freely, but not loosely, along the length of cylinder 6.

Figure 2:
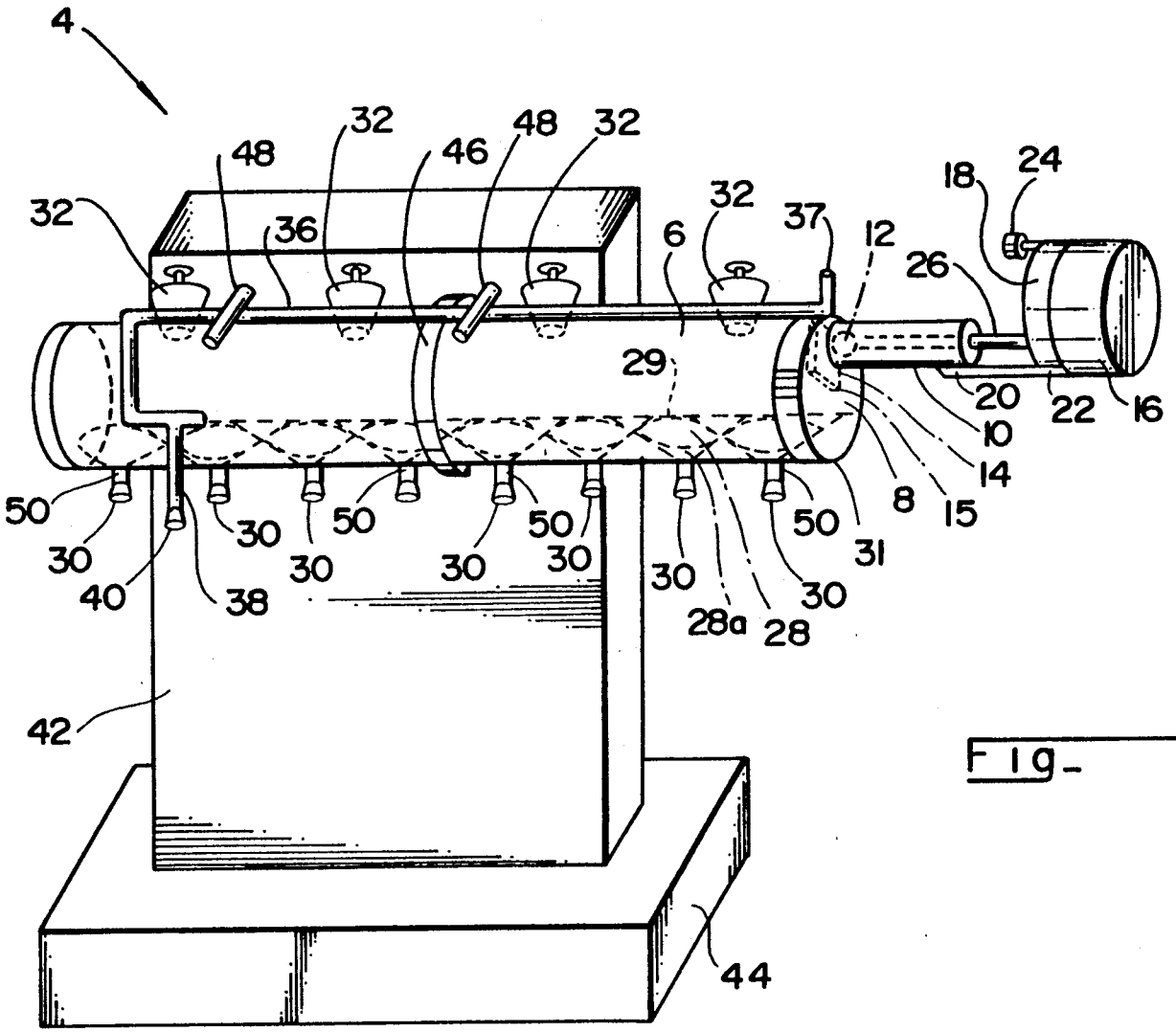
FIG. 2 is a perspective view of the sorting device shown in FIG. 1 when the container of the device is in a longitudinally horizontal position.

The central axis of each funnel 28 is perpendicular to the longitudinal central axis of cylinder 6. All these axis lie in one plane perpendicular to the central axis of the pivot shaft, which passes through portions defining a hole in sliding ring 46 and through support stand 42. Together with its attachments such as charging and collection/discharging ports, cylinder 6 can rotate about the central axis of the pivot shaft. Bars 48 are used when it is needed to fix cylinder 6 and its attachments in a horizontal position, as shown in FIG. 2. However, since bars 48 are pushed back when cylinder 6 is longitudinally in a vertical position, therefore these bars are hidden and thus depicted in broken lines in FIG. 1.

Materials of construction of cylinder 6 and its attachments such as charging port and collection/discharging ports may include plastic, glass, plexiglass, or any other material compatible with the fluid used and the material of the particles to be sorted using this sorting device.

The operation of the sorting device starts by making sure that cylinder 6 and, consequently, charging port cylinder 10, are longitudinally in a vertical position. All rubber stoppers indicated as 30, 32, and 40 are checked to ensure that they are firmly closing the openings underneath them. Now, via opening 37 and pipe 36, cylinder 6 is filled with a fluid (usually liquid, specially water). During filling, air inside cylinder 6 is displaced by the liquid and thus forced out through opening 12 and cylinder 10. The filling of cylinder 6 should be complete; the filling may be seen to be complete visually if cylinder 6 comprises a transparent material such as plexiglass, or if cylinder 6 comprises means for indicating the liquid level inside it. Filling of cylinder 6 is considered to be complete when the liquid level inside it reaches the level of opening 12. Since opening 12 is at the same level as opening 37, it follows that when cylinder 6 is positioned longitudinally in a vertical position (FIG. 1), and the liquid level inside cylinder 6 reaches the level of opening 12, any additional liquid added through opening 37 would simply displace an equal amount of liquid which would leave from cylinder 6 through opening 12 into cylinder 10. It is desirable to make sure that cylinder 6 is filled with liquid and no significant air bubbles are allowed to remain in the cylinder. This is because air bubbles tend to cause disturbance in the liquid, inside cylinder 6, when the cylinder is rotated as will be discussed later. Such disturbance would tend to affect negatively the quality of sorting of the particles, due to the fact that disturbance may cause re-mixing of some already separated particles. At this point, having cylinder 6 completely full of liquid, opening 12 is closed by allowing metal sheet 18 and shutting plate 14 to swing upwards using handle 24.

Now, the particles to be sorted are admitted into the charging port cylinder 10 and allowed to start to settle for a time which may be set by the operator of the sorting device. After the time assigned for settling of the particles in cylinder 10 passes, opening 12 is opened towards cylinder 6 by pushing handle 24 downwards. Therefore, the contents of cylinder 10, including the particles, start to enter cylinder 6. The operator of the sorting device keeps opening 12 open until all the particles and the liquid in cylinder 10 are drained into cylinder 6. Since opening 37, opening 12, and the liquid inside cylinder 6 are all at the same level, therefore, a volume of liquid is displaced from cylinder 6 through opening 37 equivalent to the volume of the particles/-liquid mixture which is charged into cylinder 6 through opening 12. Alternatively, a separate additional hole may be made in cover 8 for the purpose of providing means for the displaced fluid to escape from cylinder 6. The charging of particles from cylinder 10 into cylinder 6 should take a very short time, the length of which depends partly on the diameter of opening 12 and on the volume of the particles/liquid mixture. After charging of the particles is completed, handle 24 is pushed back upwards in order to close opening 12.

As soon as the particles are charged into cylinder 6, they start to settle according to their settling velocities, under the influence of gravitational forces. Because of the differences in their settling velocities, the particles travel different distances at any specified settling time. Therefore, the particles start to separate in their way downwards. A specified settling time may be selected by the operator of the sorting device. The length of a specified settling time depends on the estimated rang of settling velocities of the particles, the degree of sorting required, and the length of cylinder 6 itself.

After the specified settling time passes and separation of the particles takes place, cylinder 6 is rotated by 90 degrees about the longitudinal central axis of the pivot shaft which passes through sliding ring 46 and support stand 42. This rotation brings cylinder 6 to a horizontal position having the outlets of funnels 28 extending vertically downwards as shown in FIG. 2. Bars 48 are pushed forward in order to extend over sections of the top of cylinder 6 and, thus, fix the cylinder in place in a horizontal position. As mentioned earlier, it is desirable not to have significant air bubbles in cylinder 6 during its rotation, otherwise, air bubbles tend to cause disturbances which may result in re-mixing of some already separated particles and thus negatively affect the performance of the sorting device. It is preferable to rotate cylinder 6 by 90 degrees as fast and as steadily as possible. The length of the time required for rotation (or simply rotation time) depends on the features of the sorting device such as the kind of the means available for rotating cylinder 6 and whether these means are controlled manually or automatically. Once the rotation time is determined, it may be useful to consider the most practical rotation time for a given sorting device as an operating constant specific for that particular sorting device. Afterwards, it becomes preferable to use the same rotation time in all future sorting operations which use the same sorting device.

In order to ensure clarity, it is necessary to emphasize the difference between settling time and rotation time. Settling time is the time allowed for particles to settle inside cylinder 6 when it is in a longitudinally vertical position while rotation time is the time required, after the settling time itself passes, for rotating cylinder 6 by 90 degrees in order for it to take a longitudinally horizontal position.

Having cylinder 6 fixed in a longitudinally horizontal position as shown in FIG. 2, cylinder 6 is kept without disturbance for a while, two minutes for example, depending on the nature of the particles. Generally speaking, enough time should be given for the now separated particles to settle in new direction in relation to longitudinal lines in the walls of container 6, under the influence of gravitational forces. The settling in this new direction results in collection of the particles in sorted fashion in the corresponding collection/discharging ports; each port comprises a funnel indicated as 28 in the drawings.

After sufficient collection of the particles is achieved, the process of discharging the collected particles in each collection/discharging port starts. Firstly, rubber stopper 40 is removed in order to allow the liquid to flow out of cylinder 6 through pipe 38; the liquid keeps flowing out of cylinder 6 until the level of the liquid comes down to the height of the thin partition walls indicated in the drawings as 29. Secondly, rubber stopper 30 is removed from each funnel 28 and the corresponding collected particles from each funnel are discharged into different containers. Particles that may still be sticking to the interior surfaces of any funnel, or in any location bounded by the thin partition walls 29, may be flushed out by aiming a stream of liquid at them. The stream of liquid is transferred through a hose which may be admitted into cylinder 6 by removing a rubber stopper 32 in order to free the opening underneath it.

Therefore, the particles charged into cylinder 6 are now discharged, together with some liquid, as fractions sorted according to their settling velocities. These sorted particles/liquid mixtures may be filtered for further processing, if so desired. The particles before sorting are indicated in FIG. 1 as 50, located in the charging port cylinder 10. The sorted collected particles, before discharging, are also indicated in FIG. 2 as 50, but located in funnels 28 of the collection/discharging ports.

A minor problem may occur when some particles go without sorting to the collection/discharging ports immediately after being charged into cylinder 6 and while the cylinder is still longitudinally in a vertical position. This potential problem would be a function of the magnitude and direction of the driving force associated with the charging of particles into cylinder 6 through opening 12. Therefore, to safeguard against this problem, measures should be taken to reduce the magnitude of this driving force and to properly aim its direction. To reduce the magnitude of the driving force, the height of the liquid in charging port cylinder 10 is kept as low as possible in order to bring the hydrostatic pressure component of the driving force to a minimum. To aim properly the direction of the force, shutting plate 14 is designed in such a way that it has the capability of swinging to open opening 12 so that materials entering cylinder 6 are directed by the shutting plate away from the collection/discharging ports and into the bulk of the liquid. Furthermore, when cylinder 6 has large diameter, the likelihood of this problem to occur becomes even more remote.

When cylinder 6 is rotated from a longitudinally vertical position (FIG. 1) by 90 degrees in order to take a longitudinally horizontal position (FIG. 2), the direction of the settling movements of the settling particles are changed in relation to longitudinal lines in the walls of the cylinder. Therefore, the direction of the settling movements are parallel to such longitudinal lines in FIG. 1 and perpendicular to the same longitudinal lines in FIG. 2. This indicates that, generally, the direction of the settling movements of the settling particles in relation to longitudinal lines in the walls of the cylinder of a sorting device changes by the same angle of rotation of the cylinder in relation to the vertical direction. This is because the settling movements are always influenced by the gravitational forces, which have vertical direction. Any rotation of cylinder 6 does merely change the direction of the settling movements in relation to longitudinal lines in the walls of the cylinder itself However, the direction of these settling movements remains identified mainly with the vertical direction, although small deviations from the vertical direction may occur due to diffusion movements for example. This fact may be used if it is desired to rearrange particles settling in a container in certain artistic patterns appearing at different inclinations by simply rotating the container about an axis by various degrees.

Therefore, in some applications, cylinder 6 may not have to be in a longitudinally vertical position when the particles are charged and then allowed to settle and separate. Moreover, cylinder 6 may not have to be in a longitudinally horizontal position when the separated particles collect in the collection/discharging ports. Inclinations in relation to the vertical or horizontal directions may be allowed in various degrees depending on the application.

Sometimes, a need may arise to sort further an already sorted fraction of the particles having relatively low settling velocities in relation to other fractions. This may be done using the same sorting device repeatedly allowing for higher settling times, in order to give the particles more opportunity to separate. In practice, sorting of a given amount of particles can be made for a number of times. Every sorting cycle would produce fractions comprising particles which are even closer in their individual settling velocities.

In some instances, particles themselves may comprise liquid material which is immiscible with the fluid in cylinder 6. Also, besides having different settling velocities, particles may individually consist of different materials, or consist of the same materials but at different proportions. In all such instances the present invention may provide a method for separation of the materials as well as the particles themselves.

It is now seen how a sorting method which is used in conjunction with a sorting device according to the present invention is more accurate, quick, economical, and practical. The fact that particles are allowed to settle freely under the influence of gravitational forces minimizes shear stress and possible disintegration of the particles and, hence, this mode of settling improves accuracy. Depending on the length of the container (preferably cylinder-shaped container) where sorting take place, the duration of the settling process leading to separation of the particles may be measured in seconds or minutes which indicates that this method is quick. The fact that making the sorting device according to the present invention requires sieves or pumps for maintaining upflow velocities indicates that using this sorting method is economical. The fact that very few steps are necessary to achieve sorting indicates that this method is practical and is easy to use as compared to the methods which use sieves or increasing upflow velocities, for example.

Although a single preferred embodiment of the present invention has been described in detail, it will be appreciated by those skilled in the art that the present invention is not limited to the features of this embodiment, but includes all variations and modifications that may be made without departing from the spirit of the invention or the scope of the claims.

What is claimed as the invention is:

1. A method for sorting particles according to their settling velocities, comprising:

admitting particles into a container containing a fluid and allowing the particles to start to settle according to their settling velocities under the influence of gravitational forces; and after the particles travel through the fluid inside said container for a specified period of time and the corresponding separation of the particles according to their settling velocities takes place, rotating said container about an axis in order to change the direction of the settling movements of the settling particles in relation to longitudinal lines in the walls of said container, so that gravitational forces pull down the separated particles causing them to be collected in sorted fashion according to their settling velocities.

2. A method for sorting particles as claimed in claim 1, wherein said container takes a longitudinally vertical position while the particles are being admitted into the container and being allowed to start to settle according to their settling velocities under the influence of gravitational forces and, after the particles travel through the fluid inside said container for a specified period of time and the corresponding separation of the particles according to their settling velocities takes place, said container is rotated by 90 degrees about an axis in order for the container to take a longitudinally horizontal position, so that gravitational forces pull down the separated particles causing them to be collected in sorted fashion according to their settling velocities.

3. A method for sorting particles as claimed in claim 1, wherein the particles comprise gold.

4. A method for sorting particles as claimed in claim 1, wherein the particles related to soil.

5. A method for sorting particles as claimed in claim 1, wherein the particles comprise cellular structures of biological significance.

6. A device for sorting particles comprising a container, the device having the capability of sorting particles according to their settling velocities in a fluid medium inside said container, the sorting being effected by rotating said container about an axis and, therefore, changing the direction of the settling movements of the settling particles in relation to longitudinal lines in the walls of said container.

7. A device for sorting particles as claimed in claim 6, including means for supplying fluid into the container of the sorting device in such a way that the fluid flows inside the container opposite to the direction of the settling movements of the settling particles in order to slow down settling of the particles and thus make it possible to achieve a desired degree of sorting using a shorter container than would otherwise be required if such fluid supply is not used.

8. A device for sorting particles as claimed in claim 6, including means for rotating said container about an axis and, therefore, changing the angle that a central plane of said container makes with a reference plane, the changing of the angle changes the direction of the settling movements of the settling particles in relation to longitudinal lines in the walls of aid container.

9. A device for sorting particles as claimed in claim 8, including mechanical means for rotation of said container about an axis.

10. A device for sorting particles as claimed in claim 8, including electrical means for rotation of said container about an axis.

11. A device for sorting particles as claimed in claim 8, including automatic means for controlling the rotation of said container about an axis.

12. A device for sorting particles as claimed in claim 8, including means for rotating the container in order to change the angle by 90 degrees.

13. A device for sorting particles as claimed in claim 6, wherein said container having collection parts, the ports having the capability of collecting sorted particles according to their settling velocities.

14. A device for sorting particles comprising a container, the device having the capability of sorting particles according to their settling velocities and fluidization characteristics in a fluidized-bed medium inside the container, the sorting being effected by rotating said container about an axis and, therefore, changing the direction of the settling movements of the settling particles in relation to longitudinal lines in the walls of said container.

* * * * *